US008460511B2

(12) United States Patent
Huang et al.

(10) Patent No.: US 8,460,511 B2
(45) Date of Patent: Jun. 11, 2013

(54) PAPER SUBSTRATE CONTAINING A WETTING AGENT AND HAVING IMPROVED PRINTABILITY

(75) Inventors: Yan C. Huang, Williamsburg, OH (US); Kapil M. Singh, West Chester, OH (US); David B. Shelmidine, Ticonderoga, NY (US); Benjamin Thomas Liguzinski, Cincinnati, OH (US); Christopher Michael Wilson, Middletown, OH (US)

(73) Assignee: International Paper Company, Memphis, TN (US)

( * ) Notice: Subject to any disclaimer, the term of this patent is extended or adjusted under 35 U.S.C. 154(b) by 414 days.

(21) Appl. No.: 12/572,081

(22) Filed: Oct. 1, 2009

(65) Prior Publication Data

US 2010/0086709 A1 Apr. 8, 2010

Related U.S. Application Data

(60) Provisional application No. 61/194,875, filed on Oct. 1, 2008.

(51) Int. Cl.

| | |
|---|---|
| ***C08K 3/10*** | (2006.01) |
| ***D21H 17/28*** | (2006.01) |
| ***D21H 17/33*** | (2006.01) |
| ***D21H 17/66*** | (2006.01) |
| ***D21H 21/16*** | (2006.01) |

(52) U.S. Cl.

USPC ..... 162/168.1; 162/158; 162/164.1; 162/175; 162/181.2; 162/183; 162/162; 428/32.18; 106/162.1; 106/206.1; 106/215.1; 106/217.9

(58) Field of Classification Search

USPC ..... 162/158, 162, 164.1, 168.1, 175, 162/181.1, 183–185, 181.2; 428/32.18, 32.28; 524/27, 42, 52; 106/162.1, 206.1, 215.1, 106/217.9

See application file for complete search history.

(56) References Cited

U.S. PATENT DOCUMENTS

| | | | | |
|---|---|---|---|---|
| 2,322,888 | A | | 6/1943 | Schwartz et al. |
| 4,022,965 | A | | 5/1977 | Goheen et al. |
| 4,040,900 | A | | 8/1977 | Mazzarella et al. |
| 4,075,136 | A | | 2/1978 | Schaper |
| 4,166,894 | A | | 9/1979 | Schaper |
| 4,169,810 | A | | 10/1979 | Gunther et al. |
| 4,174,417 | A | | 11/1979 | Rydell |
| 4,251,824 | A | | 2/1981 | Hara et al. |
| 4,279,794 | A | | 7/1981 | Dumas |
| 4,386,965 | A | | 6/1983 | Fringeli et al. |
| 4,410,899 | A | | 10/1983 | Haruta et al. |
| 4,412,224 | A | | 10/1983 | Sugitani |
| 4,419,433 | A | | 12/1983 | Kubbota et al. |
| 4,425,405 | A | | 1/1984 | Murakami et al. |
| 4,431,481 | A | | 2/1984 | Drach et al. |
| 4,446,174 | A | * | 5/1984 | Maekawa et al. ..... 427/261 |
| 4,478,910 | A | | 10/1984 | Oshima et al. |
| 4,481,244 | A | | 11/1984 | Haruta et al. |
| 4,496,427 | A | | 1/1985 | Davison |
| 4,496,629 | A | | 1/1985 | Haruta et al. |
| 4,503,118 | A | | 3/1985 | Murakami et al. |
| 4,504,576 | A | | 3/1985 | Kemme |
| 4,517,244 | A | | 5/1985 | Kobayashi et al. |
| 4,532,530 | A | | 7/1985 | Hawkins |
| 4,554,181 | A | | 11/1985 | Cousin et al. |
| 4,576,867 | A | | 3/1986 | Miyamoto |
| 4,601,777 | A | | 7/1986 | Hawkins et al. |
| 4,636,409 | A | | 1/1987 | Arai et al. |
| 4,717,502 | A | | 1/1988 | Schmid |
| 4,740,420 | A | | 4/1988 | Akutsu et al. |
| 4,792,487 | A | | 12/1988 | Schubring et al. |
| 4,830,911 | A | | 5/1989 | Kojima et al. |
| 4,877,680 | A | | 10/1989 | Sakaki et al. |
| 4,908,240 | A | | 3/1990 | Auhorn et al. |
| 4,986,882 | A | | 1/1991 | Mackey et al. |
| 5,013,603 | A | | 5/1991 | Ogawa et al. |
| 5,026,457 | A | | 6/1991 | Eichinger et al. |
| 5,049,235 | A | | 9/1991 | Barcus et al. |
| 5,160,789 | A | | 11/1992 | Barcus et al. |
| 5,163,973 | A | | 11/1992 | Ellis |
| 5,190,805 | A | | 3/1993 | Atherton et al. |
| 5,209,953 | A | | 5/1993 | Grupe et al. |
| 5,266,250 | A | | 11/1993 | Kroyer |
| 5,270,103 | A | | 12/1993 | Oliver et al. |
| 5,302,576 | A | | 4/1994 | Tokiyoshi et al. |
| 5,314,747 | A | | 5/1994 | Malhotra et al. |
| 5,320,902 | A | | 6/1994 | Malhotra et al. |
| 5,356,018 | A | | 10/1994 | Dubach |
| 5,360,420 | A | | 11/1994 | Cook et al. |
| 5,397,619 | A | | 3/1995 | Kuroyama et al. |
| 5,405,678 | A | | 4/1995 | Bilodeau |
| 5,429,860 | A | | 7/1995 | Held et al. |
| 5,443,899 | A | | 8/1995 | Barcus et al. |
| 5,457,486 | A | | 10/1995 | Malhotra et al. |

(Continued)

FOREIGN PATENT DOCUMENTS

| | | |
|---|---|---|
| DE | 19534327 | 2/1996 |
| EP | 0187666 | 7/1986 |

(Continued)

OTHER PUBLICATIONS

"Mirabilite", Lapis Mineral Magazine [online],no date, [retrieved on Jan. 16, 2012], Retrieved from the Internet: <URL: http://webmineral.com/data/Mirabilite.shtml>.*

(Continued)

*Primary Examiner* — Mark Halpern
*Assistant Examiner* — Dennis Cordray
(74) *Attorney, Agent, or Firm* — Thomas W. Barnes, III; Eric W. Guttag

(57) ABSTRACT

The present invention relates to a sizing composition that, when applied to paper substrate, creates a substrate, preferably suitable for inkjet printing, having increased print density, and print mottle, as well as print sharpness, low HST, and/or image dry time, the substrate preferably having high brightness and reduced color-to-color bleed as well. In addition, the present invention relates to a method of reducing the HST of a paper substrate by applying the sizing composition to at least one surface thereof. Further, the application relates to methods of making and using the sizing composition, as well as methods of making and using the paper containing the sizing composition.

64 Claims, 2 Drawing Sheets

U.S. PATENT DOCUMENTS 5,474,843 A 12/1995 Lambert et al.
5,482,514 A 1/1996 von Raven
5,531,728 A 7/1996 Lash
5,537,137 A 7/1996 Held et al.
5,605,750 A 2/1997 Romano et al.
5,657,064 A 8/1997 Malhotra
5,662,773 A 9/1997 Frederick et al.
5,667,637 A 9/1997 Jewell et al.
5,695,609 A 12/1997 Petander et al.
5,698,074 A 12/1997 Baracus et al.
5,698,688 A 12/1997 Smith et al.
H1704 H 1/1998 Wallajapet et al.
5,729,266 A 3/1998 Malhotra
5,731,080 A 3/1998 Cousin et al.
5,760,809 A 6/1998 Malhotra et al.
5,783,038 A 7/1998 Donigian et al.
5,824,190 A 10/1998 Guerro et al.
5,851,651 A 12/1998 Chao
5,902,454 A 5/1999 Nelson
5,919,558 A 7/1999 Chao
5,985,424 A 11/1999 DeMatte et al.
6,030,443 A 2/2000 Bock et al.
6,132,855 A 10/2000 Becher et al.
6,146,494 A 11/2000 Seger et al.
6,187,430 B1 2/2001 Mukoyoshi et al.
6,194,077 B1 2/2001 Yuan et al.
6,241,786 B1 6/2001 Zarges et al.
6,242,082 B1 6/2001 Mukoyoshi et al.
6,310,132 B1 10/2001 Sackmann et al.
6,361,651 B1 3/2002 Sun
6,426,382 B1 7/2002 Farrar et al.
6,471,824 B1 10/2002 Jewell
6,506,282 B2 1/2003 Hu et al.
6,579,414 B2 6/2003 Jewell
6,579,415 B2 6/2003 Jewell
6,582,557 B2 6/2003 Jewell
6,592,712 B2 7/2003 Koukoulas et al.
6,592,717 B2 7/2003 Jewell
6,613,104 B2 9/2003 Zarges et al.
6,660,348 B2 12/2003 Cuch et al.
6,713,550 B2 3/2004 Schliesman et al.
6,723,846 B1 4/2004 Metzger et al.
6,761,941 B2 7/2004 Kobayashi et al.
6,764,726 B1 7/2004 Yang et al.
6,783,818 B2 8/2004 Tsuchiya et al.
6,808,767 B2 10/2004 Schliesman
6,815,021 B1 11/2004 Ishikawa et al.
6,818,685 B1 11/2004 Chapman
6,838,078 B2 * 1/2005 Wang et al. ..... 424/78.02
6,857,733 B2 2/2005 Issler
6,869,658 B2 3/2005 Becker
6,890,454 B2 5/2005 Farrar et al.
6,893,473 B2 5/2005 Neogi et al.
6,919,109 B2 7/2005 Nakano et al.
6,939,441 B2 9/2005 Nurminen et al.
6,979,481 B2 12/2005 Gaynor et al.
7,018,708 B2 3/2006 Song et al.
7,056,969 B2 6/2006 Cuch et al.
7,060,201 B2 6/2006 Farrar
7,172,651 B2 2/2007 Chen et al.
7,682,438 B2 3/2010 Song et al.
7,828,935 B2 * 11/2010 Huang et al. ..... 162/168.1
8,012,551 B2 9/2011 Song et al.
8,048,267 B2 11/2011 Koenig et al.
8,057,637 B2 11/2011 Huang et al.
2003/0013628 A1 1/2003 Farrar et al.
2003/0089888 A1 5/2003 Bacher et al.
2003/0219539 A1 11/2003 Nigam
2003/0236326 A1 12/2003 Drenker et al.
2004/0014910 A1 1/2004 Wang
2004/0032473 A1 2/2004 Ishimoto et al.
2004/0033323 A1 2/2004 Gaynor et al.
2004/0038056 A1 2/2004 Song et al.
2004/0074420 A1 4/2004 Edmunds
2004/0123966 A1 7/2004 Altman et al.
2004/0197496 A1 10/2004 Song et al.
2004/0209014 A1 10/2004 Mandai et al.
2004/0237846 A1 12/2004 Farrar
2005/0003112 A1 1/2005 Chen
2005/0003113 A1 1/2005 Chen et al.
2005/0020729 A1 1/2005 Renz et al.
2005/0032642 A1 2/2005 Serizawa
2005/0041084 A1 2/2005 Mukherjee et al.
2005/0083386 A1 4/2005 Samaanayake et al.
2005/0107254 A1 5/2005 Ogino et al.
2005/0146589 A1 7/2005 Gibbison et al.
2005/0260428 A1 11/2005 Song et al.
2006/0037512 A1 2/2006 Pawlowska et al.
2006/0060317 A1 3/2006 Roding et al.
2006/0060814 A1 3/2006 Pawlowska et al.
2006/0062942 A1 3/2006 Gaynor et al.
2006/0115612 A1 6/2006 Nakata et al.
2006/0137574 A1 6/2006 Preston et al.
2006/0159910 A1 7/2006 Song et al.
2006/0204688 A1 9/2006 Ushiku
2006/0252872 A1 11/2006 Jonckheree
2007/0014941 A1 1/2007 Chen et al.
2007/0044929 A1 3/2007 Mohan et al.
2007/0062653 A1 3/2007 Duggirala et al.
2007/0076075 A1 4/2007 Schmid et al.
2007/0087138 A1 4/2007 Koenig et al.
2007/0125267 A1 6/2007 Song et al.
2007/0193707 A1 8/2007 Nguyen
2007/0235119 A1 10/2007 McManus et al.
2008/0075869 A1 3/2008 Nellie
2008/0163993 A1 7/2008 Varnell
2008/0173420 A1 * 7/2008 Song et al. ..... 162/175
2008/0289786 A1 11/2008 Koenig et al.
2009/0148608 A1 6/2009 Nadeau et al.
2009/0165977 A1 7/2009 Huang et al.
2009/0240023 A1 9/2009 Valls et al.
2010/0086709 A1 4/2010 Huang et al.
2011/0011547 A1 1/2011 Song et al.
2012/0040200 A1 2/2012 Koenig et al.

FOREIGN PATENT DOCUMENTS

EP 0652324 5/1995
EP 0672537 9/1995
EP 0747235 12/1996
EP 0758696 2/1997
EP 0666368 B1 6/1999
EP 0958933 11/1999
EP 0629741 B1 8/2001
EP 1122085 8/2001
EP 1481811 12/2004
EP 1500746 1/2005
EP 0524279 4/2005
EP 1564018 8/2005
EP 1775141 4/2007
EP 1593698 6/2007
GB 551950 3/1943
GB 786543 11/1957
GB 903416 11/1962
GB 1373788 11/1974
GB 1533434 11/1978
GB 2205967 12/1988
JP 06202370 7/1994
JP 7257023 10/1995
JP 09119091 5/1997
JP 10226154 8/1998
JP 20001047 1/2000
JP 2006142748 6/2006
WO 9528285 10/1995
WO 9600221 1/1996
WO 9730218 8/1997
WO 9805512 2/1998
WO 9852765 11/1998
WO 0032407 6/2000
WO 0047628 8/2000
WO 0240288 3/2002
WO 02064888 A1 8/2002
WO 03054030 7/2003
WO 03078174 9/2003
WO 03092913 11/2003
WO 2004014659 2/2004
WO 2005115763 12/2005
WO 2006049545 5/2006
WO 2006050850 5/2006
WO 2006053719 5/2006

| | | | |
|---|---|---|---|
| WO | 2007053681 | | 5/2007 |
| WO | 2008039562 | | 4/2008 |
| WO | 2008073426 | A1 | 6/2008 |
| WO | WO 2010039996 | * | 4/2010 |

OTHER PUBLICATIONS

"Digital Printing>Dye Receptors/Fixing Aids", One Source Organics [online], 2006, [retrieved on Jan. 16, 2012], Retrieved from the Internet: <URL: http://www.onesourceorganics.com/Products/ReceptorsFixing.htm>.*

Smook, Gary A., Handbook of Pulp and Paper Terminology, Angus Wilde Publications, 1990, pp. 231 and 300.*

E. Strazdins, Chemistry and Application of Rosin Size, 2nd Edition, by W.F. Reynolds, Tappi Press, 1989, pp. 1-33.

C.E. Farley & R.B. Wasser, Sizing with Alkenyl Succinic Anhydride, 2nd Edition, by W.F. Reynolds, Tappi Press, 1989, pp. 51-62.

C.E. Farley and R. B. Wasser in The Sizing of Paper, Second Edition, edited by W.F. Reynolds, Tappi Press, 1989, pp. 51-62.

E. Strazdins in The Sizing of Paper, Second Edition, edited by W. F. Reynolds, Tappi Press, 1989, pp. 1-31.

Pigment Coating Techniques, Chapter 24, p. 415-417, Jukka Linnonmaa and Michael Trefz.

* cited by examiner

PAPER SUBSTRATE CONTAINING A WETTING AGENT AND HAVING IMPROVED PRINTABILITY

This application claims benefit of U.S. Provisional Application No. 61/194,875 filed Oct. 1, 2008.

FIELD OF THE INVENTION

The present invention relates to a sizing composition that, when applied to paper substrate, creates a substrate, preferably suitable for inkjet printing, having increased print density, print sharpness, low HST, and/or image dry time, the substrate preferably having high brightness and reduced color-to-color bleed as well. In addition, the present invention relates to a method of reducing the HST of a paper substrate by applying the sizing composition to at least one surface thereof. Further, the application relates to methods of making and using the sizing composition, as well as methods of making and using the paper containing the sizing composition.

BACKGROUND OF THE INVENTION

Ink jet recording systems using aqueous inks are now well known. These systems usually generate almost no noise and can easily perform multicolor recordings for business, home and commercial printing applications. Recording sheets for ink jet recordings are known. See for example U.S. Pat. Nos. 5,270,103; 5,657,064; 5,760,809; 5,729,266; 4,792,487; 5,405,678; 4,636,409; 4,481,244; 4,496,629; 4,517,244; 5,190,805; 5,320,902; 4,425,405; 4,503,118; 5,163,973; 4,425,405; 5,013,603; 5,397,619; 4,478,910; 5,429,860; 5,457,486; 5,537,137; 5,314,747; 5,474,843; 4,908,240; 5,320,902; 4,740,420; 4,576,867; 4,446,174; 4,830,911; 4,554,181; 6,764,726 and 4,877,680, which are hereby incorporated, in their entirety, herein by reference.

However, conventional paper substrates, such as those above remain poor in balancing good print density, HST, color-to-color bleed, print sharpness, and/or image dry time. Accordingly, there is a need to provide such high-performance functionality to paper substrates useful in inkjet printing, especially those substrates preferably having high brightness.

DETAILED DESCRIPTION OF THE INVENTION

Figure 1:
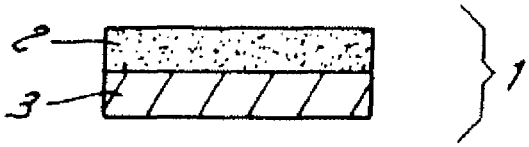
FIG. 1: A first schematic cross section of just one exemplified embodiment of the paper substrate that is included in the paper substrate of the present invention.

The present inventors have discovered a sizing composition that, when applied to paper or paperboard substrates, improves the substrate's print density, print mottle, color-to-color bleed, print sharpness, and/or image dry time. Further, the paper substrate preferably has a high brightness.

The sizing composition may contain at least one wetting agent (also known as surfactants and tensides). Examples of wetting agents include those having an HLB value of from at least 2, and at least 5 up to at most 15, at most 17, at most 18, and at most 20. The HLB value of the wetting agent may be 2, 3, 4, 5, 6, 7, 8, 9, 10, 11, 12, 13, 14, 15, 16, 17, 18, 19, and 20, including any and all ranges and subranges contained therein. In one embodiment, those wetting agents have a HLB value of from 3 to 10 are sufficient. In another embodiment, those wetting agents having a HLB value of from 12 to 20, more preferably 12-18, are sufficient. Examples of wetting agents include, but are not limited to those containing pyrrolidones such as for example caprylyl pyrrolidone, and lauryl pyrrolidone. Examples of those are Easy-Wet® commercially available from ISP Technologies. Further examples of wetting agents include glycerol esters such as those commercially available as Myverol®. These glycerol esters include glyceryl monostearate, mixtures of glyceryl monostearate and glyceryl monopalmitate (Myvaplex, Eastman Fine Chemical Company), glycerylmonooleate, a mixture of mono, di and tri-glycerides (ATMUL 84S), glycerylmonolaurate, paraffin, white wax, long chain carboxylic acids, long chain carboxylic acid esters, long chain carboxylic acid alcohols, and mixtures thereof. The long chain carboxylic acids can contain from 6 to 30 carbon atoms; in certain embodiments at least 12 carbon atoms, and in other embodiments from 12 to 22 carbon atoms. In some embodiments this carbon chain is fully saturated and unbranched, while others contain one or more double bonds. In at least one embodiment the long chain carboxylic acids contain 3-carbon rings or hydroxyl groups. Non-limiting examples of saturated straight chain acids include n-dodecanoic acid, n-tetradecanoic acid, n-hexadecanoic acid, caproic acid, caprylic acid, capric acid, lauric acid, myristic acid, palmitic acid, stearic acid, arachidic acid, behenic acid, montanic acid and melissic acid. Also useful are unsaturated monoolefinic straight chain monocarboxylic acids. Non-limiting examples of these include oleic acid, gadoleic acid and erucic acid. Also useful are unsaturated (polyolefinic) straight chain monocaboxyic acids. Non-limiting examples of these include linoleic acid, linolenic acid, arachidonic acid and behenolic acid. Useful branched acids include, for example, diacetyl tartaric acid. Non-limiting examples of long chain carboxylic acid esters include glyceryl monostearates; glyceryl monopalmitates; mixtures of glyceryl monostearate and glyceryl monopalmitate (Myvaplex 600, Eastman Fine Chemical Company); glyceryl monolinoleate; glyceryl monooleate; mixtures of glyceryl monopalmitate, glyceryl monostearate glyceryl monooleate and glyceryl monolinoleate (Myverol 18-92 and Myverol 18-06 Eastman Fine Chemical Company); glyceryl monolinolenate; glyceryl monogadoleate; mixtures of glyceryl monopalmitate, glyceryl monostearate, glyceryl monooleate, glyceryl monolinoleate, glyceryl monolinolenate and glyceryl monogadoleate (Myverol 18-99, Eastman Fine Chemical Company); acetylated glycerides such as distilled acetylated monoglycerides (Myvacet 5-07, 7-07 and 9-45, Eastman Fine Chemical Company); mixtures of propylene glycol monoesters, distilled monoglycerides, sodium stearoyl lactylate and silicon dioxide (Myvatex TL, Eastman Fine Chemical Company); mixtures of propylene glycol monoesters, distilled monoglycerides, sodium stearoyl lactylate and silicon dioxide (Myvatex TL, Eastman Fine Chemical Company) d-alpha tocopherol polyethylene glycol 1000 succinate (Vitamin E TPGS, Eastman Chemical Company); mixtures of mono- and diglyceride esters such as Atmul (Humko Chemical Division of Witco Chemical); calcium stearoyl lactylate; ethoxylated mono- and di-glycerides; lactated mono- and di-glycerides;

lactylate carboxylic acid ester of glycerol and propylene glycol; lactylic esters of long chain carboxylic acids; polyglycerol esters of long chain carboxylic acids, propylene glycol mono- and di-esters of long chain carboxylic acids; sodium stearoyl lactylate; sorbitan monostearate; sorbitan monooleate; other sorbitan esters of long chain carboxylic acids; succinylated monoglycerides; stearyl monoglyceryl citrate; stearyl heptanoate; cetyl esters of waxes; cetearyl octanoate; C10-C30 cholesterol/lavosterol esters; sucrose long chain carboxylic acid esters; and mixtures thereof.

When the composition contains a wetting agent, the wetting agent may be present in an amount ranging from at least 0.1 wt %, at least 0.5 wt %, at least 1 wt %, and at least 2 wt %, and up to at most 5 wt %, at most 10 wt %, and at most 20 wt % based upon the total weight of the solids in of the composition. This amount of wetting agent includes 0.1, 0.2, 0.5, 1, 2, 3, 4, 5, 6, 7, 8, 9, 10, 11, 12, 13, 14, 15, 16, 17, 18, 19, and 20 wt % based upon the total weight of the solids in of the composition, including any and all ranges and subranges contained therein. In one embodiment, the composition contains from 0.5 to 10 wt % of wetting agent based upon the total amount of the solids in of the composition.

The sizing composition may contain at least one inorganic salt. Suitable inorganic salts may be monovalent and/or divalent and/or trivalent and may contain any level of hydration complexes thereof. Exemplified inorganic salts are those from Groups 1, 2 and 13 from the Periodic Table of Elements and hydrated complexes thereof, including monohydrates, dihydrates, trihydrates, tetrahydrates, etc. The cationic metal may be sodium, calcium, magnesium, and aluminum preferably. The anionic counterion to the cationic metal of the inorganic salt may be any halogen such as chloride, boride, fluoride, etc and/or hydroxyl group(s). The most preferred inorganic salt being sodium chloride.

The sizing composition may contain at least one inorganic salt at any amount. When the sizing composition contains at least one inorganic salt, the inorganic salt may be present at an amount 0.25 to 90 wt %, preferably from 0.25 to 25 wt % of the inorganic salt based on the total weight of the solids in the composition. This range may include 0.25, 0.5, 1, 1.5, 2, 2.5, 3, 3.5, 4, 4.5, 5, 10, 15, 20, 25, 30, 35, 40, 45, 50, 55, 60, 65, 70, 75, 80, 85 and 90 wt % based on the total weight of the solids in the composition, including any and all ranges and subranges contained therein. In one embodiment the composition contains at least 5 wt % of inorganic salt based on the total weight of the solids in the composition.

The sizing composition may contain a binder. Examples of binders include, but are not limited to, polyvinyl alcohol, Amres (a Kymene type), Bayer Parez, polychloride emulsion, modified starch such as hydroxyethyl starch, starch or derivatives thereof including cationic and oxidized forms and from corn and/or potato for example, polyacrylamide, modified polyacrylamide, polyol, polyol carbonyl adduct, ethanedial/polyol condensate, polyamide, epichlorohydrin, glyoxal, glyoxal urea, ethanedial, aliphatic polyisocyanate, isocyanate, 1,6 hexamethylene diisocyanate, diisocyanate, polyisocyanate, polyester, polyester resin, polyacrylate, polyacrylate resin, acrylate, and methacrylate. While any combination of binders may be used, one embodiment includes a sizing composition containing starch or modifications thereof combined with polyvinyl alcohol as multi-component binder.

When there is a multicomponent binder system, one embodiment relates to a system including at least starch and deriviates thereof with polyvinyl alcohol. In this embodiment, the ratio of starch/PVOH solids based on the total weight of the solids in the sizing composition may be any ratio so long as both are present in the composition. The sizing composition may contain a ratio of starch/PVOH wt % solids based on the total weight of the solids in the composition of from 99/1 to 1/99, preferably from 50/1 to 1/5, more preferably at most 10/1 to 1:2, most preferably at most 8/1 to 1/1. This range includes 99/1, 50/1, 25/1, 15/1, 10/1, 9/1, 8/1, 7/1, 6/1, 5/1, 4/1, 3/1, 2/1, 1/1, 2/3, 1/2, 1/10, 1/25, 1/50, 1/99, including any and all ranges and subranges therein. The most preferred starch/PVOH ratio being 6/1.

When polyvinyl alcohol is utilized in the sizing solution and/or in the paper, polyvinyl alcohol (PVOH) is produced by hydrolyzing polyvinyl acetate (PVA). The acetate groups are replaced with alcohol groups and the higher the hydrolysis indicates that more acetate groups have been replaced. Lower hydrolysis/molecular weight PVOH are less viscous and more water soluble. The PVOH may have a % hydrolysis ranging from 100% to 75%. The % hydrolysis may be 75, 76, 78, 80, 82, 84, 85, 86, 88, 90, 92, 94, 95, 96, 98, and 100% hydrolysis, %, including any and all ranges and subranges therein. Preferably, the % hydrolysis of the PVOH is greater than 90%.

The sizing composition may contain a binder at any amount. The sizing composition may contain at least one binder from 0 to 99 wt %, preferably at least 10 wt %, at least 40 wt %, and/or at least 50 wt % based on the total weight of the solids in the composition. This range may include 0, 1, 5, 10, 15, 20, 25, 30, 35, 40, 45, 50, 55, 60, 65, 70, 75, 80, 85, 90, 100 wt % based on the total weight of the solids in the composition, including any and all ranges and subranges contained therein. In one embodiment, the composition may contain from 65 to 85 wt % of binder based on the total weight of the solids in the composition.

The sizing composition may contain at least one optical brightening agent (OBA). Suitable OBAs may be those mentioned in U.S. Ser. No. 60/654,712 filed Feb. 19, 2005, and U.S. Pat. No. 6,890,454, which are hereby incorporated, in their entirety, herein by reference. The OBAs may be commercially available from Clariant. Further, the OBA may be either cationic and/or anionic. Example OBA is that commercially available Leucophore BCW and Leucophore FTS from Clariant. In one embodiment, the OBA contained in the sizing composition is cationic. In another embodiment, the OBA may be also act as a dye fixative. An example of a dye fixative that is in the form of a complex with an OBA or that may also act as an OBA is that which is commercially available from Clariant as Leucophor FTS. Further examples of such dye fixative/OBA dual function compounds and/or formulations include those when the OBA is cationic rather than anionic. Still further, examples can be found in U.S. Pat. Nos. 7,060,201 and 6,890,454, which is hereby incorporated, in its entirety, herein by reference.

The sizing composition may contain any amount of at least one anionic OBA. The sizing composition may contain anionic OBA at an amount from 0 to 99 wt %, from 5 to 75 wt %, from 10 to 50 wt %, from 20 to 40 wt % based on the total weight of the solids in the composition. This range may include 0, 1, 5, 10, 15, 20, 25, 30, 35, 40, 45, 50, 55, 60, 65, 70, 75, 80, 85, 90, 99 wt % anionic OBA based on the total weight of the solids in the composition, including any and all ranges and subranges contained therein. In one embodiment, the composition may contain from 1 to 10 wt %, from 2 to 5 wt % of anionic OBA based on the total weight of the solids in the composition The sizing composition may contain any amount of at least one cationic OBA. The sizing composition may contain cationic OBA at an amount from 0 to 99 wt %, preferably from 0.5 to 25 wt %, from 1 to 20 wt %, and from 2 to 10 wt % based on the total weight of the solids in the composition. This range may include 0, 1, 5, 10, 15, 20, 25, 30, 35, 40, 45, 50, 55, 60, 65, 70, 75, 80, 85, 90, 99 wt % cationic OBA based on the total weight of the solids in the composition, including any and all ranges and subranges contained therein. In one embodiment, the composition may contain from 1 to 10 wt %, from 2 to 5 wt % of cationic OBA based on the total weight of the solids in the composition The composition may also contain a crosslinking agent. The crosslinking agent may be any chemical that is capable of crosslinking the hydroxyl groups of starch and/or the functional groups of the dye fixative. The crosslinking agent may be formaldehyde, urea, formaldehyde/urea resins, melamine, formaldehyde/melamine resins, acid anhydrides, maleic anhydride, anhydrides, metal salts, boron-containing compounds, boron containing salts, metal containing boron compounds, borates, sodium borate, ammonium salts, zirconium salts, AZT, glyoxal, blocked glyoxal such as those commercially available from Clariant (known as Cartabond TSI). Examples of blocked glyoxals are those that have the reactive groups either sterically or chemically blocked so that such groups may not react until a temperature of the compound is reached. While this temperature could be any temperature, in some circumstances the temperature could be greater than 150° Farenheit or even at least 160° Farenheit.

The sizing composition may contain any amount of at least one crosslinking agent. The sizing composition may contain at least one crosslinking agent at an amount from 0 to 99 wt %, from 0.25 to 25 wt %, from 0.5 to 10 wt %, and from 0.75 to 2 wt % based on the total weight of the solids in the composition. This range may include 0, 0.25, 0.5, 0.75, 1, 5, 10, 15, 20, 25, 30, 35, 40, 45, 50, 55, 60, 65, 70, 75, 80, 85, 90, 99 wt % crosslinking agent based on the total weight of the solids in the composition, including any and all ranges and subranges contained therein.

The sizing composition may or may not contain a pigment. Examples of pigments are clay, calcium carbonate, calcium sulfate hemihydrate, and calcium sulfate dehydrate, calcium carbonate, preferably precipitated calcium carbonate, in any form including ground calcium carbonate and silica-treated calcium carbonate. When the pigment is a calcium carbonate, it may be in any form. Examples include ground calcium carbonate and/or precipitated calcium carbonate.

The pigment may have any surface area. Those pigments having a high surface area are included, including those having a surface area of greater than 20 square meters/gram, preferably greater than 30 square meters/gram, more preferably greater than 50 square meters/gram, most preferably greater than 100 square meters/gram. This range includes greater than or equal to 1, 5, 10, 15, 20, 25, 30, 35, 40, 45, 50, 55, 60, 65, 70, 75, 80, 85, 90, 100 square meters/gram, including any and all ranges and subranges contained therein.

The sizing composition may contain a pigment at any amount. The composition may less than 15 wt %, less than 10 wt %, and less than 5 wt % pigment based upon the total weight of the solids in the composition. This range may include less than 1, 2, 3, 4, 5, 6, 7, 8, 9, 10, and 15 wt % of pigment based upon the total weight of the solids in the composition, including any and all ranges and subranges contained therein. In one embodiment, the composition does not contain pigment or does not contain substantial amounts of pigment. Thus, the composition may contain trace amounts of pigment, but preferably as little as possible.

The sizing composition may contain at least one nitrogen containing organic species acting as a dye fixative. Exemplified nitrogen containing organic species are compounds, oligomers and polymers are those containing one or more quaternary ammonium functional groups. Such functional groups may vary widely and include substituted and unsubstituted amines, imines, amides, urethanes, quaternary ammonium groups, dicyandiamides and the like. Illustrative of such materials are polyamines, polyethyleneimines, polymers and copolymers of diallyldimethyl ammonium chloride (DADMAC), copolymers of vinyl pyrrolidone (VP) with quaternized diethylaminoethylmethacrylate (DEAMEMA), polyamides, cationic polyurethane latex, cationic polyvinyl alcohol, polyalkylamines dicyandiamid copolymers, amine glycigyl addition polymers, poly[oxyethylene (dimethyliminio) ethylene (dimethyliminio) ethylene] dichlorides. Examples of nitrogen containing species include those mentioned in U.S. Pat. No. 6,764,726, which is hereby incorporated, in its entirety, herein by reference. The most preferred nitrogen containing species are polymers and copolymers of diallyldimethyl ammonium chloride (DADMAC).

The sizing composition may contain at least one nitrogen containing organic species at any amount. The sizing composition may contain the nitrogen containing species at an amount ranging from 0.5 to 50 wt %, from 1 to 20 wt %, and from 2 to 10 wt % based on the total weight of the solids in the composition. This range may include 0, 0.5, 1, 2, 3, 4, 5, 6, 7, 8, 9, 10, 15, 20, 25, 30, 35, 40, 45, and 50 wt % based on the total weight of the solids in the composition, including any and all ranges and subranges contained therein. In one embodiment, the composition does not contain a nitrogen containing organic species or does not contain substantial amounts of a nitrogen containing organic species. Thus, the composition may contain trace amounts of a nitrogen containing organic species, but preferably as little as possible. The present invention also relates to a paper substrate containing any of the sizing compositions described above.

The paper substrate contains a web of cellulose fibers. The source of the fibers may be from any fibrous plant. The paper substrate of the present invention may contain recycled fibers and/or virgin fibers. Recycled fibers differ from virgin fibers in that the fibers have gone through the drying process at least once.

The paper substrate of the present invention may contain from 1 to 99 wt %, preferably from 5 to 95 wt %, most preferably from 60 to 80 wt % of cellulose fibers based upon the total weight of the substrate, including 1, 5, 10, 15, 20, 25, 30, 35, 40, 45, 50, 55, 60, 65, 70, 75, 80, 85, 90, 95 and 99 wt %, and including any and all ranges and subranges therein.

While the fiber source may be any, the preferable sources of the cellulose fibers are from softwood and/or hardwood. The paper substrate of the present invention may contain from 1 to 100 wt %, preferably from 5 to 95 wt %, cellulose fibers originating from softwood species based upon the total amount of cellulose fibers in the paper substrate. This range includes 1, 2, 5, 10, 15, 20, 25, 30, 35, 40, 45, 50, 55, 60, 65, 70, 75, 80, 85, 90, 95, and 100 wt %, including any and all ranges and subranges therein, based upon the total amount of cellulose fibers in the paper substrate.

The paper substrate of the present invention may contain from 1 to 100 wt %, preferably from 5 to 95 wt %, cellulose fibers originating from hardwood species based upon the total amount of cellulose fibers in the paper substrate. This range includes 1, 2, 5, 10, 15, 20, 25, 30, 35, 40, 45, 50, 55, 60, 65, 70, 75, 80, 85, 90, 95, and 100 wt %, including any and all ranges and subranges therein, based upon the total amount of cellulose fibers in the paper substrate.

When the paper substrate contains both hardwood and softwood fibers, it is preferable that the hardwood/softwood ratio be from 0.001 to 1000. This range may include 0.001, 0.002, 0.005, 0.01, 0.02, 0.05, 0.1, 0.2, 0.5, 1, 2, 5, 10, 15, 20, 25, 30, 35, 40, 45, 50, 55, 60, 65, 70, 75, 80, 85, 90, 95, 100, 200, 300, 400, 500, 600, 700, 800, 900, and 1000 including any and all ranges and subranges therein and well as any ranges and subranges therein the inverse of such ratios.

Further, the softwood and/or hardwood fibers contained by the paper substrate of the present invention may be modified by physical and/or chemical means. Examples of physical means include, but is not limited to, electromagnetic and mechanical means. Means for electrical modification include, but are not limited to, means involving contacting the fibers with an electromagnetic energy source such as light and/or electrical current. Means for mechanical modification include, but are not limited to, means involving contacting an inanimate object with the fibers. Examples of such inanimate objects include those with sharp and/or dull edges. Such means also involve, for example, cutting, kneading, pounding, impaling, etc means.

Examples of chemical means include, but is not limited to, conventional chemical fiber modification means including crosslinking and precipitation of complexes thereon. Examples of such modification of fibers may be, but is not limited to, those found in the following U.S. Pat. Nos. 6,592,717, 6,592,712, 6,582,557, 6,579,415, 6,579,414, 6,506,282, 6,471,824, 6,361,651, 6,146,494, H1,704, 5,731,080, 5,698,688, 5,698,074, 5,667,637, 5,662,773, 5,531,728, 5,443,899, 5,360,420, 5,266,250, 5,209,953, 5,160,789, 5,049,235, 4,986,882, 4,496,427, 4,431,481, 4,174,417, 4,166,894, 4,075,136, and 4,022,965, which are hereby incorporated, in their entirety, herein by reference. Further modification of fibers is found in U. S. patent applications having application Ser. No. 60/654,712 filed Feb. 19, 2005; Ser. Nos. 11/358,543 filed Feb. 21, 2006; 11/445,809 filed Jun. 2, 2006; and 11/446,421 filed Jun. 2, 2006, which may include the addition of optical brighteners (i.e. OBAs) as discussed therein, which are hereby incorporated, in their entirety, herein by reference.

One example of a recycled fiber is a "fine". Sources of "fines" may be found in SaveAll fibers, recirculated streams, reject streams, waste fiber streams. The amount of "fines" present in the paper substrate can be modified by tailoring the rate at which such streams are added to the paper making process.

The paper substrate preferably contains a combination of hardwood fibers, softwood fibers and "fines" fibers. "Fines" fibers are, as discussed above, recirculated and are any length. Fines may typically be not more that 100 μm in length on average, preferably not more than 90 μm, more preferably not more than 80 μm in length, and most preferably not more than 75 μm in length. The length of the fines are preferably not more than 5, 10, 15, 20, 25, 30, 35, 40, 45, 50, 55, 60, 65, 70, 75, 80, 85, 90, 95, and 100 μm in length, including any and all ranges and subranges therein.

The paper substrate may contain fines at any amount. The paper substrate may contain from 0.01 to 100 wt % fines, preferably from 0.01 to 50 wt %, most preferably from 0.01 to 15 wt % based upon the total weight of the fibers contained by the paper substrate. The paper substrate contains not more than 0.01, 0.05, 0.1, 0.2, 0.5, 1, 2, 3, 4, 5, 6, 7, 8, 9, 10, 12, 15, 20, 25, 30, 35, 40, 45, 50, 55, 60, 65, 70, 75, 80, 85, 90, 95 and 100 wt % fines based upon the total weight of the fibers contained by the paper substrate, including any and all ranges and subranges therein.

The paper substrate may also contain an internal sizing and/or external sizing composition. The internal sizing composition may be applied to the fibers during papermaking at the wet end, while the external sizing composition may be applied to the fibers via a size press and/or coater. The above mentioned sizing compositions of the present invention may be the internal and/or external sizing composition contained by the paper substrate of the present invention.

Figure 2:
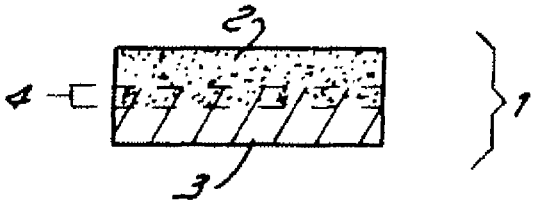
FIG. 2: A second schematic cross section of just one exemplified embodiment of the paper substrate that is included in the paper substrate of the present invention.
Figure 3:
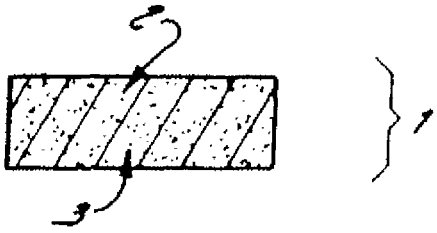
FIG. 3: A third schematic cross section of just one exemplified embodiment of the paper substrate that is included in the paper substrate of the present invention.

FIGS. 1-3 demonstrate different embodiments of the paper substrate 1 in the paper substrate of the present invention. FIG. 1 demonstrates a paper substrate 1 that has a web of cellulose fibers 3 and a sizing composition 2 where the sizing composition 2 has minimal interpenetration of the web of cellulose fibers 3. Such an embodiment may be made, for example, when a sizing composition is coated onto a web of cellulose fibers.

FIG. 2 demonstrates a paper substrate 1 that has a web of cellulose fibers 3 and a sizing composition 2 where the sizing composition 2 interpenetrates the web of cellulose fibers 3. The interpenetration layer 4 of the paper substrate 1 defines a region in which at least the sizing solution penetrates into and is among the cellulose fibers. The interpenetration layer may be from 1 to 99% of the entire cross section of at least a portion of the paper substrate, including 1, 2, 5, 10, 15, 20, 25, 30, 35, 40, 45, 50, 55, 60, 65, 70, 75, 80, 85, 90, 95, and 99% of the paper substrate, including any and all ranges and subranges therein. Such an embodiment may be made, for example, when a sizing composition is added to the cellulose fibers prior to a coating method and may be combined with a subsequent coating method if required. Addition points may be at the size press, for example.

FIG. 3 demonstrates a paper substrate 1 that has a web of cellulose fibers 3 and a sizing solution 2 where the sizing composition 2 is approximately evenly distributed throughout the web of cellulose fibers 3. Such an embodiment may be made, for example, when a sizing composition is added to the cellulose fibers prior to a coating method and may be combined with a subsequent coating method if required. Exemplified addition points may be at the wet end of the paper making process, the thin stock, and the thick stock.

The paper substrate may be made by contacting any component of the sizing solution with the cellulose fibers consecutively and/or simultaneously. Still further, the contacting may occur at acceptable concentration levels that provide the paper substrate of the present invention to contain any of the above-mentioned amounts of cellulose and components of the sizing solution. The contacting may occur anytime in the papermaking process including, but not limited to the thick stock, thin stock, head box, and coater with the preferred addition point being at the thin stock. Further addition points include machine chest, stuff box, and suction of the fan pump. Preferably, the components of the sizing solution are preformulated either together and/or in combination within a single and/or separate coating layer(s) and coated onto the fibrous web via a size press and/or coater.

The paper or paperboard of this invention can be prepared using known conventional techniques. Methods and apparatuses for forming and making and applying a coating formulation to a paper substrate are well known in the paper and paperboard art. See for example, G. A. Smook referenced above and references cited therein all of which is hereby incorporated by reference. All such known methods can be used in the practice of this invention and will not be described in detail.

The paper substrate may contain the sizing composition at any amount. The paper substrate may contain the sizing composition at an amount ranging from 70 to 300 lbs/ton of paper, preferably from 80 to 250 lbs/ton of paper, more preferably from 100 to 200 lbs/ton of paper, most preferably from 115 to 175 lbs/ton of paper. This range includes, 70, 80, 90, 100, 110, 120, 130, 135, 140, 150, 160, 170, 180, 190, 200, 210, 220, 230, 240, 250, 260, 270 280, 290, and 300 lbs/ton of paper, including any and all ranges and subranges therein. In a preferred embodiment the paper substrate contains a size press applied sizing composition at an amount of from 110 to 150 lbs/ton of paper substrate.

Given the above mentioned preferred amounts of sizing composition contained in the substrate of the present invention, combined with the above-mentioned amounts of binder, inorganic salt, OBA and wetting agent; the amounts of each of the binder, inorganic salt, OBA and wetting agent that are contained in the paper may be easily calculated. For example, if 50 wt % of binder is present in the sizing solution based upon the total weight of solids in the composition, and the paper substrate contains 150 lbs of the sizing composition/ton, then the paper substrate contains 50%×150 lbs/ton of paper=75 lbs binder/ton of paper, which is 75 lbs/2000 lbs×100=3.75 wt % binder based upon the total weight of the paper substrate.

The paper substrate contains any amount of at least one wetting agent. The paper substrate may contain from 0.001 wt % to 5 wt %, from 0.01 to 2.5 wt %, from 0.02 to 1 wt %, and from 0.05 to 0.5 wt % of wetting agent based upon the total weight of the substrate. This range includes 0.001, 0.002, 0.005, 0.007, 0.01, 0.02, 0.03, 0.05, 0.06, 0.07, 0.08, 0.09, 0.1, 0.2, 0.3, 0.4, 0.5, 0.6, 0.7, 0.8, 0.9, 1, 1.2, 1.4, 1.6, 1.8, 2.0, 2.2, 2.4, 2.6, 2.8, 3, 3.5, 4, and 5 wt % of wetting agent based upon the total weight of the substrate, including any and all ranges and subranges therein.

The paper substrate contains any amount of at least inorganic salt. The paper substrate may contain from 1 wt % to 20 wt %, from 2 to 10 wt %, 3 to 8 wt % of inorganic salt based upon the total weight of the substrate. This range includes at least 1, 2, 3.5, 4, 5, 5.5, 6, 7, 7.5, 8, 9, 10, 11, 12, 13, 14, 15, 16, 17, 18, 19, and 20 wt % of inorganic salt based upon the total weight of the substrate, including any and all ranges and subranges therein.

The paper substrate contains any amount of at least one binder. The paper substrate may contain from 0.1 wt % to 10 wt %, from 1 to 7 wt %, and from 2 to 5 wt % based upon the total weight of the substrate. This range includes 0.1, 0.2, 0.3, 0.4, 0.5, 1, 1.5, 2, 2.5, 3, 3.5, 4, 4.5, 5, 5.5, 6, 6.5, 7, 7.5, 8, 9, and 10 wt % of binder based upon the total weight of the substrate, including any and all ranges and subranges therein.

The paper substrate may contain any amount of OBA. The OBA may be cationic and/or anionic. The OBA may be supplied by the sizing composition as mentioned above and/or within the substrate itself. For example, the OBA may be premixed with the fibers at the wet end of the papermaking and even before the headbox. Preferred examples of using OBA:fiber mixes is found in United States patent applications having application Ser. Nos. 11/358,543 filed Feb. 21, 2006; 11/445,809 filed Jun. 2, 2006; and 11/446,421 filed Jun. 2, 2006, which are hereby incorporated, in their entirety, herein by reference.

In one embodiment of the present invention, the paper substrate contains internal OBA and externally applied OBA. The internal OBA may be cationic or anionic, but is preferably anionic. The externally applied OBA may be cationic or anionic, but is preferably cationic. The externally applied OBA is preferably applied as a member of the sizing composition at the size press as mentioned above in the above preferred amounts of OBA. However, external OBA may also be applied at the coating section.

In one embodiment when the OBA is a cationic OBA, the paper substrate contains from 1 to 10 wt % of externally applied OBA based upon the total weight of the paper. This range includes 1, 2, 3, 4, 5, 6, 7, 8, 9 and 10 wt % of OBA based upon the total weight of the substrate, including any and all ranges and subranges therein.

The paper substrate of the present invention may have any amount of OBA. In one embodiment, the OBA is present in as sufficient amount so that the paper has at least 80% GE brightness. The GE brightness is preferably at least 80, 85, 90, 91, 92, 93, 94, 95, 96, 97, 98, 99, and 100%, including any and all ranges and subranges contained therein.

Further, the paper may have a suitable amount of OBA and other additives (such as dyes) so that the paper preferably has a CIE whiteness of at least 130. The CIE whiteness may be at least 130, 135, 140, 145, 150, 155, 160, 65, 170, 175, 180, 185, 190, 195, and 200 CIE whiteness points, including any and all ranges and subranges therein.

In one embodiment, the substrate contains an effective amount of OBA. An effective amount of OBA is such that the GE brightness is at least 90, preferably at least 92, more preferably at least 94 and most preferably at least 95% brightness. The OBA may be a mixture of the above-mentioned internal and externally applied OBA, whether cationic and/or anionic so long as it is an effective amount.

The density, basis weight and caliper of the web of this invention may vary widely and conventional basis weights, densities and calipers may be employed depending on the paper-based product formed from the web. Paper or paperboard of invention preferably have a final caliper, after calendering of the paper, and any nipping or pressing such as may be associated with subsequent coating of from about 1 mils to about 35 mils although the caliper can be outside of this range if desired. More preferably the caliper is from about 4 mils to about 20 mils, and most preferably from about 7 mils to about 17 mils. The caliper of the paper substrate with or without any coating may be 1, 2, 3, 4, 5, 6, 7, 8, 9, 10, 11, 12, 13, 14, 15, 17, 20, 22, 25, 27, 30, 32, and 35, including any and all ranges and subranges therein.

Paper substrates of the invention preferably exhibit basis weights of from about 10 lb/3000 $ft^2$ to about 500 lb/3000 $ft^2$, although web basis weight can be outside of this range if desired. More preferably the basis weight is from about 30 lb/3000 $ft^2$ to about 200 lb/3000 $ft^2$, and most preferably from about 35 lb/3000 $ft^2$ to about 150 lb/3000 $ft^2$. The basis weight may be 10, 12, 15, 17, 20, 22, 25, 30, 32, 35, 37, 40, 45, 50, 55, 60, 65, 70, 75, 80, 85, 90, 95, 100, 110, 120, 130, 140, 150, 160, 170, 180, 190, 200, 225, 250, 275, 300, 325, 350, 375, 400, 425, 450, 500 lb/3000 $ft^2$, including any and all ranges and subranges therein.

The final density of the papers may be calculated by any of the above-mentioned basis weights divided by any of the above-mentioned calipers, including any and all ranges and subranges therein. Preferably, the final density of the papers, that is, the basis weight divided by the caliper, is preferably from about 6 lb/3000 $ft^2$/mil to about 14 lb/3000 $ft^2$/mil although web densities can be outside of this range if desired. More preferably the web density is from about 7 lb/3000 $ft^2$/mil to about 13 lb/3000 $ft^2$/mil and most preferably from about 9 lb/3000 $ft^2$/mil to about 12 lb/3000 $ft^2$/mil.

The web may also include other conventional additives such as, for example, starch, expandable microspheres, mineral fillers, bulking agents, sizing agents, retention aids, internal sizing agents, external sizing agents, and strengthening polymers. Among the fillers that may be used are organic and inorganic pigments such as, by way of example, polymeric particles such as polystyrene latexes and polymethylmethacrylate, and minerals such as calcium carbonate, kaolin, and talc. Other conventional additives include, but are not restricted to, wet strength resins, internal sizes, dry strength resins, alum, fillers, pigments and dyes. Internal sizing helps prevent the surface size from soaking into the sheet, thus allowing it to remain on the surface where it has maximum effectiveness. The internal sizing agents encompass any of those commonly used at the wet end of a paper machine. These include rosin sizes, ketene dimers and multimers, and alkenylsuccinic anhydrides. The internal sizes are generally used at levels of from about 0.00 wt. % to about 0.25 wt. % based on the weight of the dry paper sheet. Methods and materials utilized for internal sizing with rosin are discussed by E. Strazdins in The Sizing of Paper, Second Edition, edited by W. F. Reynolds, Tappi Press, 1989, pages 1-33. Suitable ketene dimers for internal sizing are disclosed in U.S. Pat. No. 4,279,794, which is incorporated by reference in its entirety, and in United Kingdom Patent Nos. 786,543; 903,416; 1,373,788 and 1,533, 434, and in European Patent Application Publication No. 0666368 A3. Ketene dimers are commercially available, as Aquapel.RTM. and Precis.RTM. sizing agents from Hercules Incorporated, Wilmington, Del. Ketene multimers for use in internal sizes are described in: European Patent Application Publication No. 0629741A1, corresponding to U.S. patent application Ser. No. 08/254,813, filed Jun. 6, 1994; European Patent Application Publication No. 0666368A3, corresponding to U.S. patent application Ser. No. 08/192,570, filed Feb. 7, 1994; and U.S. patent application Ser. No. 08/601,113, filed Feb. 16, 1996. Alkenylsuccinic anhydrides for internal sizing are disclosed in U.S. Pat. No. 4,040,900, which in incorporated herein by reference in its entirety, and by C. E. Farley and R. B. Wasser in The Sizing of Paper, Second Edition, edited by W. F. Reynolds, Tappi Press, 1989, pages 51-62. A variety of alkenylsuccinic anhydrides are commercially available from Albemarle Corporation, Baton Rouge, La. Internal sizing agents may also be applied externally.

The paper substrate may be made by contacting further optional substances with the cellulose fibers as well. The contacting of the optional substances and the cellulose fibers may occur anytime in the papermaking process including, but not limited to the thick stock, thin stock, head box, size press, water box, and coater. Further addition points include machine chest, stuff box, and suction of the fan pump. The cellulose fibers, components of the sizing composition, and/or optional components may be contacted serially, consecutively, and/or simultaneously in any combination with each other. The cellulose fibers components of the sizing composition may be pre-mixed in any combination before addition to or during the paper-making process.

The paper substrate may be pressed in a press section containing one or more nips. However, any pressing means commonly known in the art of papermaking may be utilized. The nips may be, but is not limited to, single felted, double felted, roll, and extended nip in the presses. However, any nip commonly known in the art of papermaking may be utilized.

The paper substrate may be dried in a drying section. Any drying means commonly known in the art of papermaking may be utilized. The drying section may include and contain a drying can, cylinder drying, Condebelt drying, IR, or other drying means and mechanisms known in the art. The paper substrate may be dried so as to contain any selected amount of water. Preferably, the substrate is dried to contain less than or equal to 10% water.

The paper substrate may be passed through a size press, where any sizing means commonly known in the art of papermaking is acceptable. The size press, for example, may be a puddle mode size press (e.g. inclined, vertical, horizontal) or metered size press (e.g. blade metered, rod metered). At the size press, sizing agents such as binders may be contacted with the substrate. Optionally these same sizing agents may be added at the wet end of the papermaking process as needed. After sizing, the paper substrate may or may not be dried again according to the above-mentioned exemplified means and other commonly known drying means in the art of papermaking. The paper substrate may be dried so as to contain any selected amount of water. Preferably, the substrate is dried to contain less than or equal to 10% water. Preferably, the sizing apparatus is a puddle size press.

The paper substrate may be calendered by any commonly known calendaring means in the art of papermaking. More specifically, one could utilize, for example, wet stack calendering, dry stack calendering, steel nip calendaring, hot soft calendaring or extended nip calendering, etc. While not wishing to be bound by theory, it is thought that the presence of the expandable microspheres and/or composition and/or particle of the present invention may reduce and alleviate requirements for harsh calendaring means and environments for certain paper substrates, dependent on the intended use thereof.

The paper substrate may be microfinished according to any microfinishing means commonly known in the art of papermaking. Microfinishing is a means involving frictional processes to finish surfaces of the paper substrate. The paper substrate may be microfinished with or without a calendering means applied thereto consecutively and/or simultaneously. Examples of microfinishing means can be found in United States Published Patent Application 20040123966 and references cited therein, which are all hereby, in their entirety, herein incorporated by reference.

The Hercules Sizing Test Value ("HST") of the substrate is selected to provide the desired waterfastness characteristics. The HST is measured using the procedure of TAPPI 530 pm-89. The paper substrate of the present invention may have any HST. In some embodiments, the HST may be as much as 400, 300, 200, and 100 seconds. Further, the HST may be is as low as 0.1, 1, 5 and 10 seconds. However, in a preferred embodiment of this invention, the HST is less than 10 seconds, preferably, less than 5 seconds, more preferably less than 3 seconds HST, most preferably less than about 1 second. The HST may be 0.001, 0.01, 0.05, 0.1, 0.5, 1, 1.5, 2, 2.5, 3, 3.5, 4, 4.5, 5, 5.5, 6, 6.5, 7, 7.5, 8, 8.5, 9, 9.5 and 10 seconds, including any and all ranges and subranges therein. As it is well known to those of ordinary skill in the art, the HST will vary directly with the basic weight of the substrate and other factors known to those of ordinary skill in the art. Based upon the foregoing information, one of ordinary skill in the art can use conventional techniques and procedures to calculate, determine and/or estimate a particular HST for the substrate used to provide the desired image waterfastness characteristics.

The paper substrate of the present invention may have any black optical density as measured by TAPPI METHOD T 1213 sp-03. The black optical density may be from 0.5 to 2.0, more preferably from 1.0 to 1.5. The black optical density may be 0.5, 0.6, 0.7, 0.8, 0.9, 1.0, 1.05, 1.06, 1.07, 1.08, 1.09, 1.10, 1.11, 1.12, 1.13, 1.14, 1.15, 1.16, 1.17, 1.18, 1.19, 1.2, 1.3, 1.4, and 1.5, including any and all ranges and subranges therein.

From density, one can naturally calculate waterfastness using the following equation:

$$(OD \text{ of soaked ink area}/OD \text{ of unsoaked ink area}) *100 = \% \text{ Waterfastness.}$$

The paper substrate of the present invention may have any waterfastness. The paper substrate may have a waterfastness of at least 90%, preferably at least 95%, more preferably greater than 98%, most preferably greater than 100%, including any and all ranges and subranges therein.

In an embodiment of the present invention, a paper substrate may having at least one surface, preferably at least two surfaces, having an improved print mottle. The print mottle of at least one surface may be less than 20, preferably less than 9.0, most preferably less than 8.5 on at least one side of the substrate. Print mottle may be measured as disclosed in United States Published Applications 20070044929 and 20060060317, which are hereby incorporated, in their entirety, herein by reference. Print mottle may also be measured by the Print Non-Uniformity Index which includes printing an image on a substrate, using Adobe PhotoShop's histogram to graph the intensity of dark and light pixels within a uniform color within the image. A standard deviation is calculated by Adobe Photoshop's histogram tool. Accordingly, a high standard deviation indicates an increase as the number of shades within in an image increase. Accordingly, the steps to calculate the print mottle as a function of the Print Non-Uniformity measurement is: 1) Scan an image into Adobe Photoshop at 600 dpi; 2) Select the solid uniform color area of the image that you want to test using Photoshop's marquee tool. The size of the area should be as large as possible without going outside the solid image area. Open the histogram window and set the channel to Luminosity. The standard deviation value can then be plotted, compared, and contrasted with other paper substrates containing the same image and having the same histogram plotted over the same portion of the same image.

The print mottle of the substrate may be improved by 3%, preferably 5%, more preferably 7%, and most preferably by 10% compared to that of conventional paper substrates, especially those conventional substrates when not containing wetting agents. A preferred improvement in the print mottle is in the range or from 3 to 7%, more preferably from 5 to 15%, most preferably at least 20% compared to that of conventional paper substrates, especially those conventional substrates when not containing wetting agents.

The present invention is explained in more detail with the aid of the following embodiment example which is not intended to limit the scope of the present invention in any manner.

EXAMPLES

Example 1

No pigment is present in the compositions of this example. This example employs a wetting agent in a size press formulation/composition to provide the inkjet (IJ) recording media with new and improved end-use performance.

Glossary

Substrate: typical commodity grade of an IJ recording media for commercial, web-fed, high-speed IJ presses. The substrate is 60 lbs/3300 square feet.

Ziegler 650: high quality commercial grade IJ recording media for commercial, web-fed, high-speed IJ presses.

Substrate+Wetting Agent 2 (1%)+CaCl2: this is an inventive example and is high quality commercial grade of an IJ recording media for commercial, web-fed, high-speed IJ presses and offset pre-printable Wetting Agent 1: commonly used wetting agent, glycerol ester type. Myverol 18-06 is the actual used.

Wetting Agent 2: aliphatic pyrrolidone type. International Specialty Products (ISP) Easy-Wet 20 was used.

% of wetting agent: based on the amount of starch in the size press formulation, e.g., 1% means 1 lb of the wetting agent per 100 lbs of starch in the size press formulation CaCl2: For the two CaCl2-containing conditions, each has 15 lbs/ton in it.

Photoshop Print Non-Uniformity Index: as described above.

TABLE 1

Formulations in the example:

| | starch Cargill 235D (lbs/ton) | Leucophor FTS (lbs/ton) | Cartabond TSI (lbs/ton) | Wetting Agent 1 (lbs/ton) | Wetting Agent 2 (lbs/ton) | CaCl2 (lbs/ton) |
|---|---|---|---|---|---|---|
| substrate | 90 | 2 | 1 | 0 | 0 | 0 |
| substrate + WettingAgt#1(10%) | 90 | 2 | 1 | 9 | 0 | 0 |
| substrate + WettingAgt#1(10%) + CaCl2 | 90 | 2 | 1 | 9 | 0 | 15 |
| substrate + WettingAgt#2(1%) | 90 | 2 | 1 | 0 | 1 | 0 |
| substrate + WettingAgt#2(1%) + CaCl2 | 90 | 2 | 1 | 0 | 1 | 15 |
| Ziegler 650 | | | (commercial product) | | | |

Figure 4:
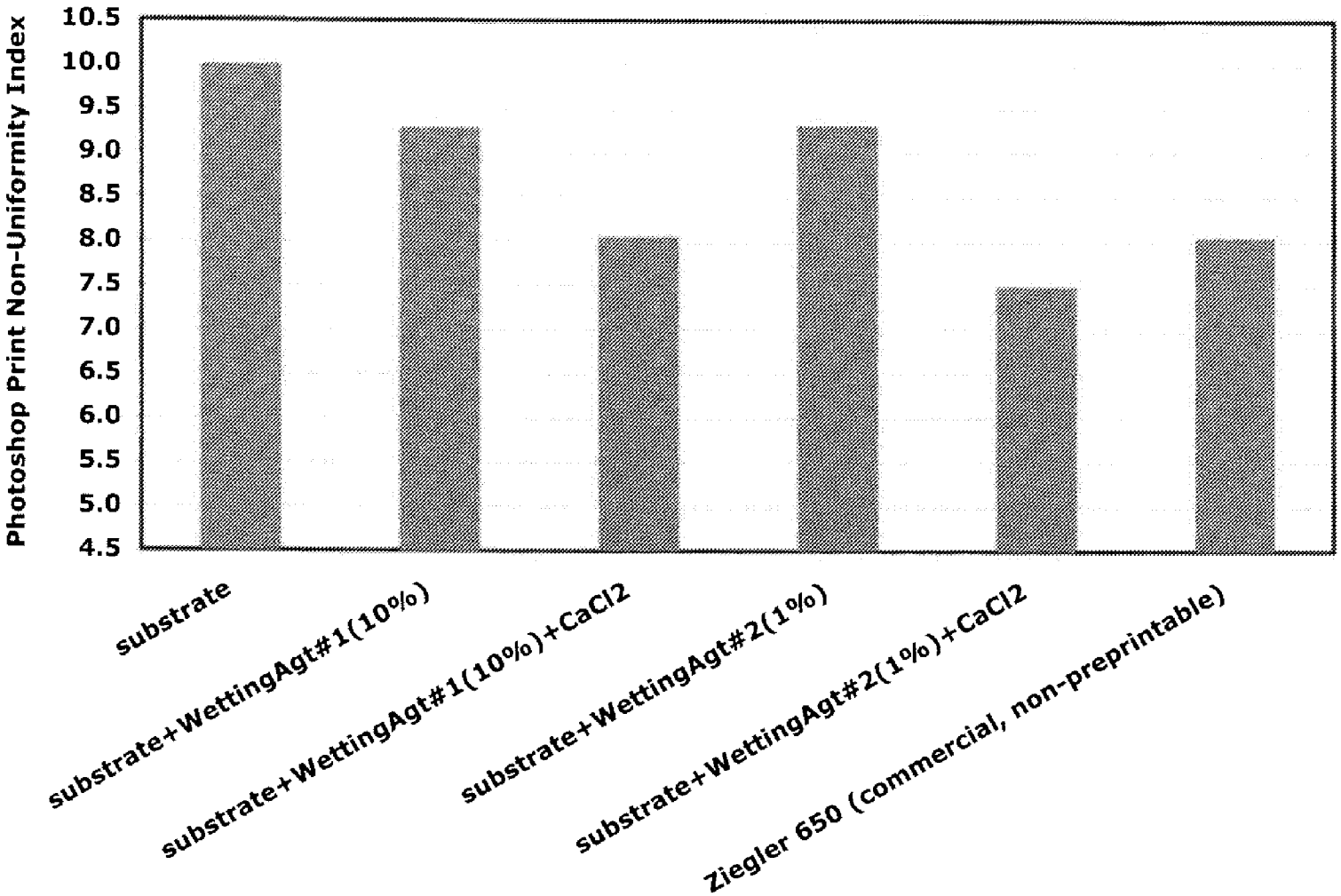
FIG. 4: Graphic illustration of print non-uniformity indexes (a quantitative analysis of print mottle) of various paper substrates described in Example 1.

About 120 lbs/ton of the formulations above were added to the substrate via a puddle size press. The Photoshop Print Non-Uniformity Index of each of the examples were measured and plotted in FIG. 4. From FIG. 4, both wetting agents improve print uniformity. Further, wetting agent 2 is more effective as 1% thereof is equivalent of the effect of 10% of wetting agent 1. Both wetting agents are compatible with inorganic salts such as calcium chloride. Wetting agent 2 has an additional advantage to even further lower the print non-uniformity than wetting agent 1. The formulations of this invention which includes wetting agent 1 and/or 2 matches or is better than the performance of a commercial paper substrate, i.e. Ziegler 650 that does not contain the composition of the present invention. Thus, Ziegler 650 is not offset pre-printable, but the paper substrates of the present invention are offset pre-printable.

Numerous modifications and variations on the present invention are possible in light of the above teachings. It is, therefore, to be understood that within the scope of the accompanying claims, the invention may be practiced otherwise than as specifically described herein.

As used throughout, ranges are used as a short hand for describing each and every value that is within the range, including all subranges therein.

All of the references, as well as their cited references, cited herein are hereby incorporated by reference with respect to relative portions related to the subject matter of the present invention and all of its embodiments.

What is claimed is:

1. A sizing composition, comprising:

no pigment;

at least one binder in an amount of at least 10 wt % based upon the total weight of the solids of the composition;

at least one inorganic salt in an amount of from 0.25 to 90 wt % based upon the total weight of the solids of the composition;

a cationic optical brightening agent in an amount of from 0.5 to 25 wt % based on the total weight of solids of the composition; and at least one wetting agent which is selected from the group consisting of glycerol monoesters and aliphatic pyrrolidones in an amount of at least 0.1 wt % based upon the total weight of the solids of the composition, wherein said cationic optical brightening agent is a dye fixative.

2. The sizing composition according to claim 1, comprising:

at least two binders.

3. The sizing composition according to claim 2, wherein the at least two binders are polyvinyl alcohol and starch.

4. The sizing composition according to claim 1, wherein the total amount of binder present is at least 20 wt % based upon the total weight of the solids of the composition.

5. The sizing composition according to claim 1, wherein the cationic optical brightening agent is present in an amount of from 2 to 5 wt % based upon the total weight of the solids of the composition.

6. The sizing composition according to claim 1, wherein:

the at least one binder is in an amount of at least 40 wt % based upon the total weight of the solids of the composition;

the at least one inorganic salt is in an amount of from 0.25 to 25 wt % based upon the total weight of the solids of the composition, and the at least one wetting agent is in an amount of from 0.5 to 10 wt % based upon the total weight of the solids of the composition.

7. The sizing composition according to claim 6, comprising p1 at least two binders wherein the at least two binders are starch and polyvinyl alcohol.

8. The sizing composition according to claim 1, wherein the at least one wetting agent is at least one of: caprylyl pyrrolidone or lauryl pyrrolidone.

9. The sizing composition according to claim 1, wherein the at least one wetting agent has an HLB value of from 14 to 20.

10. The sizing composition according to claim 1, wherein the at least one wetting agent is at least one of: glyceryl monostearate; glyceryl monopalmitate; glyceryl monolaurate; glyceryl monooleate; glyceryl monolinoleate; or glyceryl monogadoleate.

11. The sizing composition according to claim 1, wherein the at least one wetting agent has an HLB of from 3 to 10.

12. The sizing composition according to claim 1, wherein the at least one inorganic salt is calcium chloride.

13. A paper substrate, comprising the sizing composition according to claim 1 in an amount of from 70 to 300 lbs/ton of paper substrate.

14. The paper substrate according to claim 13, which has a black optical density of from 1.0 to 1.5.

15. The paper substrate according to claim 13, which has a waterfastness of at least 95%.

16. The paper substrate according to claim 13, wherein the paper substrate has at least two surfaces, each of said surfaces having a surface print mottle of less than 20 as measured by the print non-uniformity index.

17. The paper substrate according to claim 16, wherein each of said surfaces has a surface print mottle of less than 9.0 as measured by the print non-uniformity index.

18. The paper substrate according to claim 17, which has a black optical density of from 1.0 to 1.5 and an HST of not more than 10 seconds.

19. The paper substrate according to claim 18, which has a waterfastness of at least 95%.

20. The paper substrate according to claim 13, which comprising the sizing composition in an amount of from 115 to 175 lbs/ton of paper substrate.

21. A method of making a paper substrate, comprising contacting a web of cellulose fibers with a sizing composition in an amount of from 70 to 300 lbs per ton of web, wherein the sizing composition comprises:

no pigment;

a least one binder in an amount of at least 10 wt % based upon the total weight of the solids of the composition;

at least one inorganic salt in an amount of from 0.25 to 90 wt % based upon the total weight of the solids of the composition;

a cationic optical brightening agent in an amount of from 0.5 to 25 wt % based on the total weight of solids of the composition; and at least one wetting agent which is selected from the group consisting of glycerol monoesters and aliphatic pyrrolidones in an amount of at least 0.1 wt % based upon the total weight of the solids of the composition, wherein said cationic optical brightening agent is a dye fixative.

22. The method according to claim 21, wherein the contacting occurs at the wet end, the size press, or the coater.

23. The method according to claim 22, comprising contacting the web with the sizing composition at the size press in an amount such that from 50 to 110 lbs of binder is applied per ton of web, from 1.5 to 15 lbs of wetting agent is applied per ton of web, and from 5 to 30 lbs of inorganic salt is applied per ton of web.

24. The method according to claim 21, wherein said sizing composition further comprises at least two binders.

25. The method according to claim 24, wherein the at least two binders are polyvinyl alcohol and starch.

26. The method according to claim 21, wherein the total amount of binder present is at least 20 wt % based upon the total weight of the solids of the composition.

27. The method according to claim 21, wherein:

the at least one binder is in an amount of at least 40 wt % based upon the total weight of the solids of the composition;

the at least one inorganic salt is in an amount of from 0.25 to 25 wt % based upon the total weight of the solids of the composition, and the at least one wetting agent is in an amount of from 0.5 to 10 wt % based upon the total weight of the solids of the composition.

28. The method according to claim 27, comprising p1 at least two binders wherein the at least two binders are starch and polyvinyl alcohol.

29. The method according to claim 21, wherein the at least one wetting agent is at least one of: caprylyl pyrrolidone or lauryl pyrrolidone.

30. The method according to claim 21, wherein the at least one wetting agent has an HLB value of from 14 to 20.

31. The method according to claim 21, wherein the at least one wetting agent is at least one of: glyceryl monostearate; glyceryl monopalmitate; glyceryl monolaurate; glyceryl monooleate; glyceryl monolinoleate; or glyceryl monogadoleate.

32. The method according to claim 21, wherein the at least one wetting agent has an HLB of from 3 to 10.

33. The method according to claim 21, wherein the at least one inorganic salt is calcium chloride.

34. A sizing composition, comprising:

no pigment;

at least one binder in an amount of at least 10 wt % based upon the total weight of the solids of the composition;

at least one inorganic salt in an amount of from 0.25 to 90 wt % based upon the total weight of the solids of the composition; and at least one wetting agent which is selected from the group consisting of glyceryl monostearate; glyceryl monopalmitate; glyceryl monolaurate; glyceryl monooleate; glyceryl monolinoleate; or glyceryl monogadoleate in an amount of at least 0.1 wt % based upon the total weight of the solids of the composition.

35. The sizing composition according to claim 34, comprising:

at least two binders.

36. The sizing composition according to claim 35, wherein the at least two binders are polyvinyl alcohol and starch.

37. The sizing composition according to claim 34, wherein the total amount of binder present is at least 20 wt % based upon the total weight of the solids of the composition.

38. The sizing composition according to claim 34, further comprising an optical brightening agent in an amount of from 0.5 to 25 wt % based on the total weight of solids of the composition.

39. The sizing composition according to claim 38, wherein the optical brightening agent is cationic.

40. The sizing composition according to claim 38, wherein the optical brightening agent is present in an amount of from 2 to 5 wt % based upon the total weight of the solids of the composition.

41. The sizing composition according to claim 34, wherein:

the at least one binder is in an amount of at least 40 wt % based upon the total weight of the solids of the composition;

the at least one inorganic salt is in an amount of from 0.25 to 25 wt % based upon the total weight of the solids of the composition, and the at least one wetting agent is in an amount of from 0.5 to 10 wt % based upon the total weight of the solids of the composition.

42. The sizing composition according to claim 41, comprising at least two binders wherein the at least two binders are starch and polyvinyl alcohol; and an optical brightener in an amount of from 0.5 to 25 wt % based on the total weight of solids of the composition.

43. The sizing composition according to claim 34, wherein the at least one wetting agent has an HLB value of from 14 to 20.

44. The sizing composition according to claim 34, wherein the at least one wetting agent has an HLB of from 3 to 10.

45. The sizing composition according to claim 34, wherein the at least one inorganic salt is calcium chloride.

46. A paper substrate, comprising the sizing composition according to claim 34 in an amount of from 70 to 300 lbs/ton of paper substrate.

47. The paper substrate according to claim 46, which has a black optical density of from 1.0 to 1.5.

48. The paper substrate according to claim 46, which has a waterfastness of at least 95%.

49. The paper substrate according to claim 46, wherein the paper substrate has at least two surfaces, each of said surfaces having a surface print mottle of less than 20 as measured by the print non-uniformity index.

50. The paper substrate according to claim 49, wherein each of said surfaces has a surface print mottle of less than 9.0 as measured by the print non-uniformity index.

51. The paper substrate according to claim 50, which has a black optical density of from 1.0 to 1.5 and an HST of not more than 10 seconds.

52. The paper substrate according to claim 51, which has a waterfastness of at least 95%.

53. The paper substrate according to claim 46, comprising the sizing composition in an amount of from 115 to 175 lbs/ton of paper substrate.

54. A method of making a paper substrate, comprising contacting a web of cellulose fibers with a sizing composition in an amount of from 70 to 300 lbs per ton of web, wherein the sizing composition comprises:

no pigment;

at least one binder in an amount of at least 10 wt % based upon the total weight of the solids of the composition;

at least one inorganic salt in an amount of from 0.25 to 90 wt % based upon the total weight of the solids of the composition; and at least one wetting agent which is selected from the group consisting of glyceryl monostearate; glyceryl monopalmitate; glyceryl monolaurate; glyceryl monooleate; glyceryl monolinoleate; or glyceryl monogadoleate in an amount of at least 0.1 wt % based upon the total weight of the solids of the composition.

55. The method according to claim 54, wherein the contacting occurs at the wet end, the size press, or the coater.

56. The method according to claim 55, comprising contacting the web with the sizing composition at the size press in an amount such that from 50 to 110 lbs of binder is applied per ton of web, from 1.5 to 15 lbs of wetting agent is applied per ton of web, and from 5 to 30 lbs of inorganic salt is applied per ton of web.

57. The method according to claim 54, wherein said sizing composition further comprises at least two binders.

58. The method according to claim 57, wherein the at least two binders are polyvinyl alcohol and starch.

59. The method according to claim 54, wherein the total amount of binder present is at least 20 wt % based upon the total weight of the solids of the composition.

60. The method according to claim 54, wherein:

the at least one binder is in an amount of at least 40 wt % based upon the total weight of the solids of the composition;

the at least one inorganic salt is in an amount of from 0.25 to 25 wt % based upon the total weight of the solids of the composition, and the at least one wetting agent is in an amount of from 0.5 to 10 wt % based upon the total weight of the solids of the composition.

61. The method according to claim 60, comprising at least two binders wherein the at least two binders are starch and polyvinyl alcohol; and an optical brightener in an amount of from 0.5 to 25 wt % based on the total weight of solids of the composition.

62. The method according to claim 54, wherein the at least one wetting agent has an HLB value of from 14 to 20.

63. The method according to claim 54, wherein the at least one wetting agent has an HLB of from 3 to 10.

64. The method according to claim 54, wherein the at least one inorganic salt is calcium chloride.

* * * * *